US008446233B2

(12) United States Patent
Sakata

(10) Patent No.: US 8,446,233 B2
(45) Date of Patent: May 21, 2013

(54) WAVEGUIDE, ANTENNA AND VEHICULAR RADAR APPARATUS

(75) Inventor: Kazuki Sakata, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 987 days.

(21) Appl. No.: 12/355,364

(22) Filed: Jan. 16, 2009

(65) Prior Publication Data

US 2010/0052822 A1 Mar. 4, 2010

(30) Foreign Application Priority Data

Aug. 26, 2008 (JP) ..... 2008-217030

(51) Int. Cl.
*H01P 3/12* (2006.01)
*H01Q 13/10* (2006.01)

(52) U.S. Cl.
USPC ..... 333/239; 343/711; 343/771; 343/841

(58) Field of Classification Search
USPC ..... 333/239, 248, 249, 254; 343/711, 343/771, 841
See application file for complete search history.

(56) References Cited

U.S. PATENT DOCUMENTS 3,617,960 A * 11/1971 Lavedan, Jr. ..... 333/239
3,784,938 A * 1/1974 Cuthbert et al. ..... 333/239

FOREIGN PATENT DOCUMENTS

DE 10 2008 056 705 A1 12/2009
JP 2000-341030 A 12/2000
JP 2004-015579 A 1/2004
JP 2004-221718 A 8/2004
JP 2005-020147 A 1/2005

OTHER PUBLICATIONS

German Office Action dated May 24, 2012 issued in German Application No. 10 2009 000 447.5 (with English translation) (10 pages).

* cited by examiner

*Primary Examiner* — Benny Lee
*Assistant Examiner* — Gerald Stevens
(74) *Attorney, Agent, or Firm* — Sughrue Mion, PLLC

(57) ABSTRACT

A waveguide, that is improved in size, costs, manufacturing and in durability, has a base having a mounting surface, and a plate member held on the mounting surface of the base for defining a waveguide in cooperation with the base. The mounting surface of the base is a curved surface defined by a sweep of a flexure curve of the plate member when it is loaded along a straight line. The plate member is attached to the base in such a manner that the plate member is pressed against and curved along the mounting surface, and that the plate member has a curvature direction edge portion extending in a curvature direction which is a general extension of the flexure curve and a sweep direction edge portion extending in a direction of the sweep of the curve.

23 Claims, 14 Drawing Sheets

WAVEGUIDE, ANTENNA AND VEHICULAR RADAR APPARATUS

BACKGROUND OF THE INVENTION

This invention relates to a waveguide, antenna and vehicular radar apparatus and to, more particularly, a waveguide suitable for microwave or millimeter wave band applications, antenna using the same and vehicular radar apparatus using the same.

In the conventional waveguide structure, a base made of an electrically conductive material has formed therein radio wave input and output ports and a waveguide groove, and a metal plate is intimately attached to a mounting surface on a side in which the waveguide groove is formed, whereby a waveguide is defined between the waveguide groove and the plate. In such the waveguide, in order to prevent any leakage of a high frequency signal through a small gap between the mounting surface of the base and the plate, it is proposed apply a joining by screws, joining by brazing and joining by electrically conductive rubber or electrically conductive bonding agent to ensure a reliable joint between the electrically conductive members to establish an electrical conduction.

However, joining method by screws requires a number of screws tightened with a narrow pitch around the waveguide in order not to allow the metal plate warp and separate from the base due to insufficient tightening force between the screws, so that the manufacturing is not easy. Also, for a small waveguide used in millimeter band or the like, it is not possible to provide a space for securing the screws.

Also, joining method by brazing is poor in productivity and costly and needed a counter measure against over flowed brazing material. The joining by the electrically conductive rubber or the electrically conductive bonding agent has problems in that they generate a loss due to their conductivity lower than metals and also the electrical conductivity is degraded due to aging, rubber protrusion and running of the bonding agent.

It is also proposed, in Japanese Patent Laid-Open Nos. 2004-15579, 2004-221718 and 2000-341030, to combine electrically conductive bumps with a adhesive sheet or a bonding agent, or to use a choking structure provided at the gap to prevent the leakage of a high frequency signal.

However, the combination of the bonding agent and the bump structure has disadvantages of the running of the bonding agent and the breakage of the electrical conduction by the floating of the bumps due to the thermal expansion of the bonding agent. The choke structure is advantageous from the view point of aging, temperature characteristics and manufacture, but needed to have a space for the choking grooves in the vicinity of the gap, so that it is disadvantageous in that the miniaturization is prevented and a very fine choking groove must be provided at a very high cost.

Accordingly, the object of the present invention is to provide a waveguide, antenna and vehicular radar apparatus improved in size, costs, manufacturing and in durability

SUMMARY OF THE INVENTION

The present invention resides in a wave guide that comprises a base having a mounting surface, and a plate member held on said mounting surface of said base for defining a waveguide path in cooperation with said base. The mounting surface of said base is a curved surface defined by a sweep of a flexure curve of said plate member when it is loaded along a straight line. The plate member is attached to said base in such a manner that said plate member is pressed against and curved along said mounting surface, and said plate member has a curvature direction edge portion extending in a curvature direction which is a direction of general extension of the flexure curve and a sweep direction edge portion extending in a direction of sweep of said curve.

The present invention also resides in an antenna comprising an antenna element disposed on the plate member of the waveguide as claimed in any one of preceding claims. The present invention also resides in a vehicular radar apparatus having an antenna as claimed in any one of preceding claims.

BRIEF DESCRIPTION OF THE DRAWINGS

The present invention will become more readily apparent from the following detailed description of the preferred embodiments of the present invention taken in conjunction with the accompanying drawings, in which.

DESCRIPTION OF THE PREFERRED EMBODIMENTS

Figure 1:
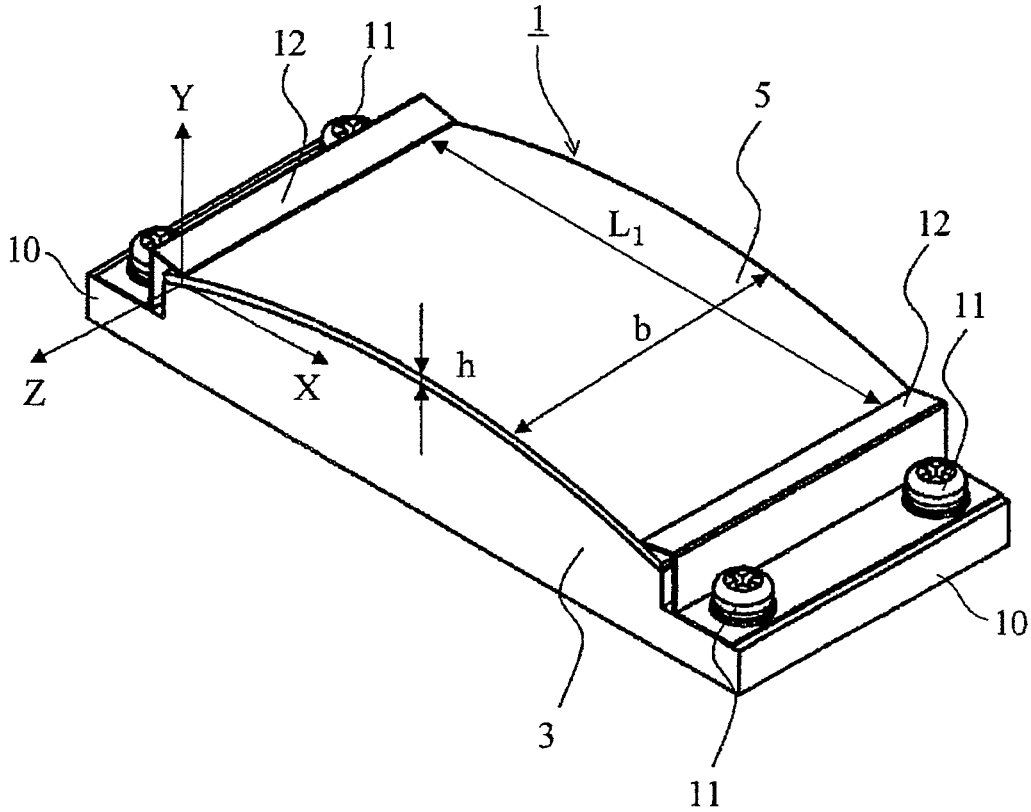
FIG. 1 is a perspective view illustrating the waveguide of embodiment 1 of the present invention.
Figure 2:
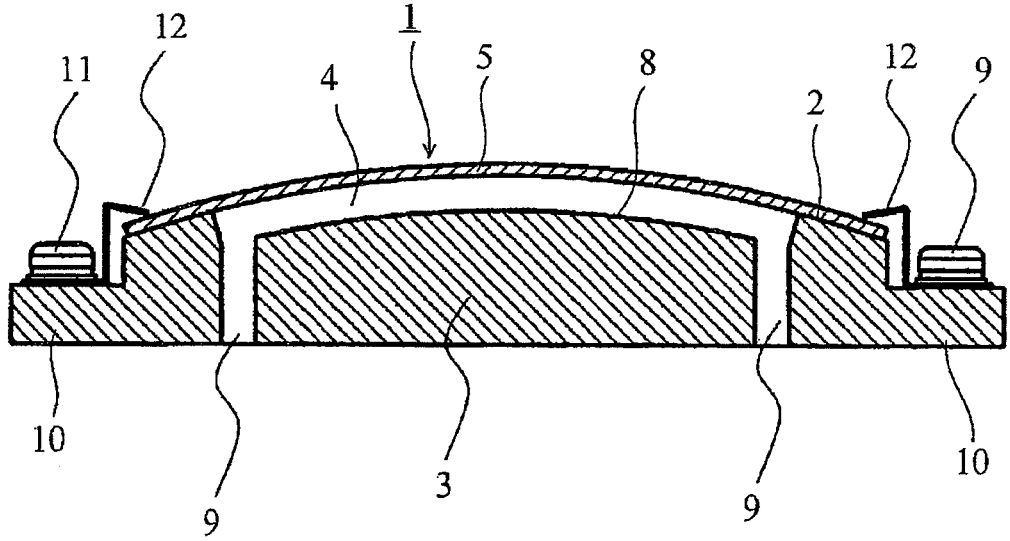
FIG. 2 is a sectional view of the wave guide shown in FIG. 1.
Figure 3:
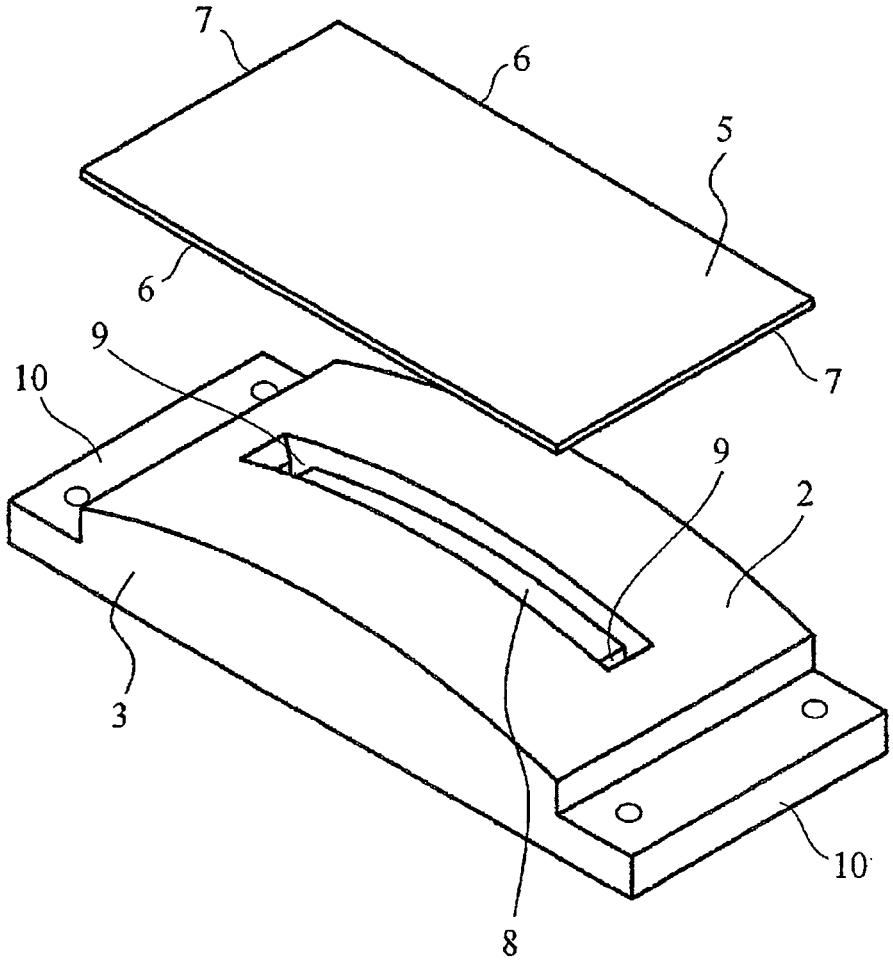
FIG. 3 is a exploded perspective view of the wave guide shown in FIG. 1.
Figure 4:
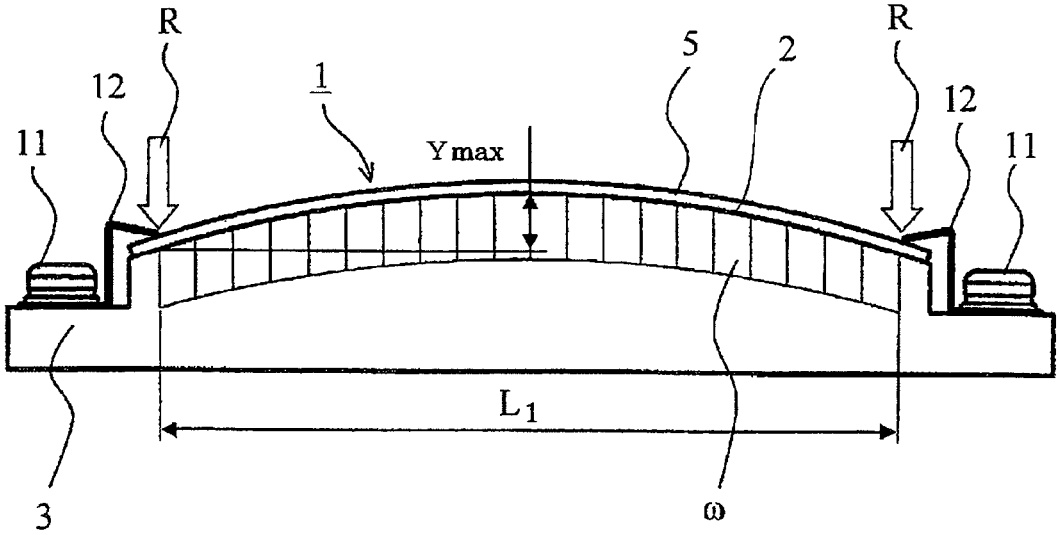
FIG. 4 is a side view for explaining distributed load, support force and flexure of the plate member of the wave guide shown in FIG. 1.

FIG. 1 is a perspective view illustrating the waveguide of embodiment 1 of the present invention, FIG. 2 is a sectional view of the wave guide shown in FIG. 1, FIG. 3 is a exploded perspective view of the wave guide shown in FIG. 1, and FIG. 4 is a side view for explaining distributed load, support force and flexure of the plate member of the wave guide shown in FIG. 1.

In these figures, the waveguide 1 comprises a base 3 having a curved mounting surface 2, and a plate member 5 held on the mounting surface 2 of the base 3 for defining a waveguide path 4 in cooperation with the base 3. The mounting surface 2 of the base 3 is a curved surface defined by a sweep of a flexure curve of the plate member 5 when it is loaded along a straight line. The mounting surface 2 is a substantially rectangular cylindrical surface having an edge portion extending in a curvature direction X and an edge portion extending in a sweep direction Z. The plate member 5 is attached to the base 3 in such a manner that the plate member 5 is pressed against and curved along the mounting surface 2. The plate member 5 has a uniform elasticity trough the whole plate member 5 and is urged against the mounting surface 2 under a even load throughout the entire region of the plate member 5 due to a reaction force of the leaf spring at the entire region on the plate member 5

In the waveguide 1 shown in FIGS. 1 to 4, the plate member 5 is a substantially rectangular metal plate, and held on the mounting surface 2 which is a convex surface of the base 3 to provide a similar curved surface. The plate member 5 has a curvature direction edge portion 6 extending in a curvature direction X which is a direction of general extension of the flexure curve and a sweep direction edge portion 7 extending in a direction of sweep Z of the curve. The plate member 5 is held at the sweep direction in a curved state at the sweep direction edge portion 7

Also, the base 3 is a substantially rectangular single metal plate made of an electrically conductive material and comprises a waveguide groove 8 formed in the mounting surface 2 which is convex surface and an input/output port 9 communicated with the waveguide groove 8. The waveguide groove 8 cooperates with the plate member 5 to define the waveguide path 4 having the input/output port 9 for the radio wave. The plate member 5 is held on the base 3 in the state in which it is urged against the curved mounting surface 2 of the base 3 by holders 12 secured by screws 11 to the flange 10 at the longitudinal ends of the base 3. Here, the term "edge portion" of the curvature direction edge portion 6 and the sweep direction edge portion means a portion of a predetermined region including and spreading from an edge or a side of the substantially rectangular plate member 5. In the illustrated example, an abutting position at which the holder 12 abuts the plate member 5 is on a straight line on the plate member 5 parallel to and spaced apart from the edge of the plate member 5, and a holding position at which the plate member 5 is urged against and held on the base 3 by the holder 12 is on a surface of the base 3 on the side of the plate member 5 corresponding to the abutting position. Therefore, the abutting position in which the holder 12 abuts against the plate member 5 as well as the holding position in which the plate member 5 is held on the base 3 are both on the edge portion which is a portion in the vicinity of the edge including the edge of the plate member 5.

FIG. 4 is a side view for explaining distributed load ω, support force R and the amount of flexure Ymax of the plate member 5 pressed against the mounting surface 2 of the base 3 at the edge portions at both ends.

Curvature curve of the mounting surface 2 is expressed by equation (1), the mounting surface 2 being a curved surface obtained by sweeping or moving this curve along a straight line. The support force R by the holder 12 for holding the plate member 5 on the base 3 can be expressed by equation (2) per one side. The flexed plate member 5 as a leaf spring urges itself by the support force R against the mounting surface 2 of the base 3 with a uniform distributed load ω over the entire length.

$$Y=16Y\max\times X(X^3-2L_1X^2+L_1^3)/(5L_1^4) \quad (1)$$

The support force R by the holder 12 for the plate member 5 per one side is:

$$R=192Ebh^3Y\max\times X/(60L_1^3) \quad (2)$$

where,

Ymax: maximum amount of flexure at given point

L: distance between the holding positions of the plate member 5

E: coefficient of longitudinal elasticity of the plate member 5 b: length of sweep direction edge portion of the plate member 5 h: thickness of the plate member 5 coordinates system is as shown in FIG. 2;

point of origin: one of support positions on plate members (point of contact between sweep direction edge portion of the plate member 5 and base 3)

X-axis: curvature direction (perpendicular to waveguide width direction that is not curved)

Equations (1) and (2) can be easily obtained from formulae of the flexure curve and the maximum flexure for a beam supported at both ends loaded with an evenly distributed load over its entire length as well as formula of second area of moment generally known in dynamics of material. In FIG. 1, z-axis indicates the sweep direction.

Therefore, when the plate-like plate member 5 is flexed along the mounting surface 2 of the base 3 and secured at the both ends by the supporting force R expressed by equation (2) to the base 3 having the mounting surface 2 of the swept curved surface made by sweeping the flexure curve of the simple beam supported at both ends with a uniformly distributed load over the entire length expressed by equation (1), the plate member 5 is pressed against the mounting surface 2 of the base 3 with the uniformly distributed load w over the entire length, ensuring a stable electrical conduction over the entire surface of the mounting surface 2 and preventing the leakage of the electromagnetic wave.

Thus, the curved mounting surface 2 of the base 3 is the curved surface obtained by sweeping the flexure curve (equation 1), which expresses the flexure of the plate member 5 supported at both ends and subjected to a uniform load, along a straight line, and is the rectangular curved surface having the curvature direction edge portion extending in the curvature direction and the sweep direction edge portion extending in the sweep direction. Therefore, the curved surface of the plate member 5 held on and flexed along the mounting surface 2 is also the rectangular curved surface obtained by sweeping the curve of equation (1) along a straight line.

Also, the plate member 5 is held at the sweep direction edge portions 7 on the base 3 by the holders 12 mounted to the flange 10 at the both ends spaced apart in the curvature direction of the curved surface of the mounting surface 2, so that the major surface of the plate member 5 facing to the base 3 is pressed against the mounting surface 2 with the uniform load to establish an intimate contact therebetween. Thus, the assembly of the plate member 5 to the base 3 may be achieved by holding only the edge of the plate member 5 extending in the width direction of the waveguide or the sweep direction edge portion 7, eliminating the need for the plate member to be tightened at four sides by a number of screws at a narrow pitch as in the conventional joining method utilizing screws, thereby making the manufacture easy.

As has been described, the plate member 5 is flexed in the flexure curve configuration of the simple beam supported at both ends and bearing a uniformly distributed load over the entire length, and held at both ends by the support force of the simple beam supported at both ends and bearing a uniformly distributed load over the entire length, so that the plate member 5 is assembled in the flexed state, which brings about the state in which it is always pressed against the mounting surface 2 of the base 3 by the reaction force as a leaf spring, enabling to eliminate any gap between the plate member 5 and the mounting surface 2 and to establish a good electrical conduction, whereby losses at the lines and poor isolation against other lines due to the leakage of high frequency signal can be prevented.

Also, the assembly of the base 3 and the plate member 5 can be achieved only by flexing and combining the plate member 5 along the mounting surface 2 of the base 3, there being no need to put it in a special high temperature furnace as in the brazing, resulting in a high productivity enabling a manufacture at a low cost.

Also, there is no need that the jointed portion between the plate member 5 and the base 3 has inserted a component having a poor electrical conductivity and durability, the plate member 5 and the base 3 being in a direct contact with each other, so that the there is no problem of generating loss, aging and temperature characteristics, proving a superior durability and temperature characteristics. Also, there is no problem of sagging and preservation of the bonding agent and is superior in productivity. Also, the plate member may be a flat plate and the mating member is only required to have a curved surface, and requires no complex structure such as micro choke structure and bump structure, enabling to decrease cost The holders 12 which are leaf springs for holding the plate member 5 can be easily designed to have the force expressed by equation (2). Also, disassembly also is easy. Also, when screws are used, heads of the screws 11 may project from the plate member 5 or the slot plate at the outermost side and affects the radio wave properties, but the holder 12 of the leaf spring has only a small portion projecting into the outer space, thereby enabling to obtain a good radio wave properties.

Embodiment 2

Figure 5:
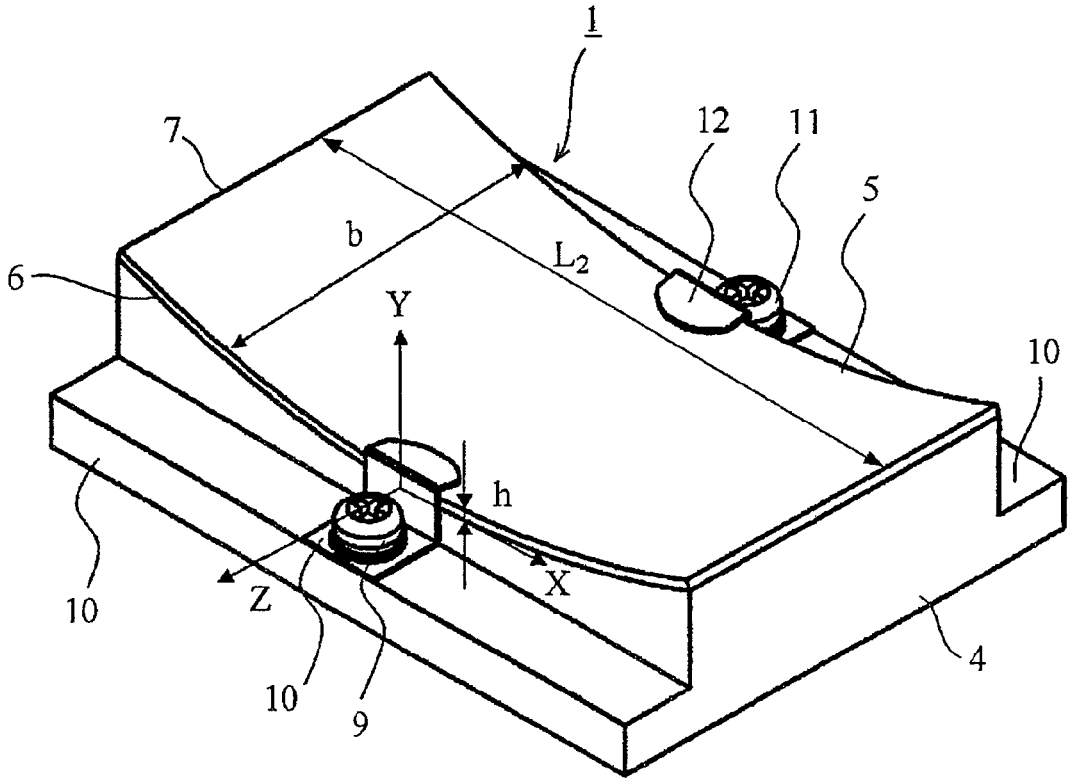
FIG. 5 is a perspective view illustrating the waveguide of embodiment 2 of the present invention.
Figure 6:
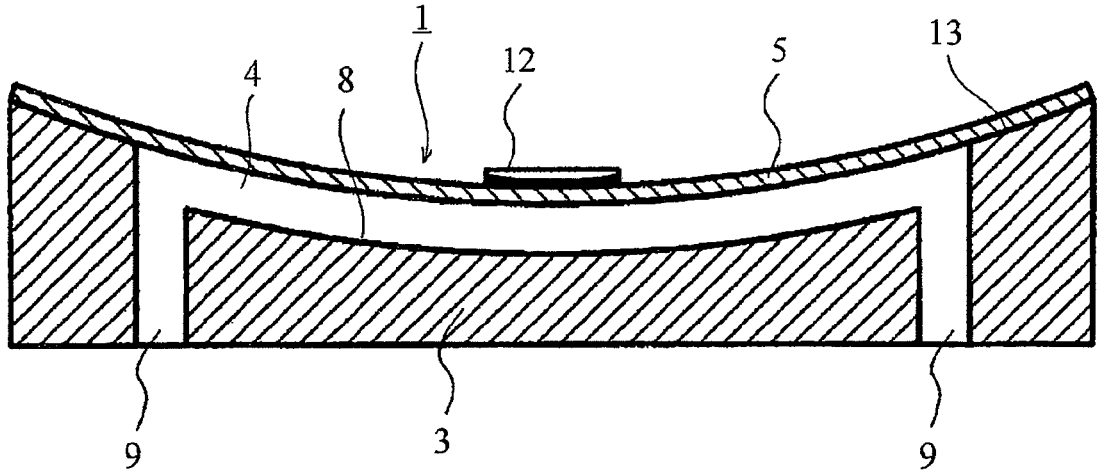
FIG. 6 is a sectional view of the wave guide shown in FIG. 5.
Figure 7:
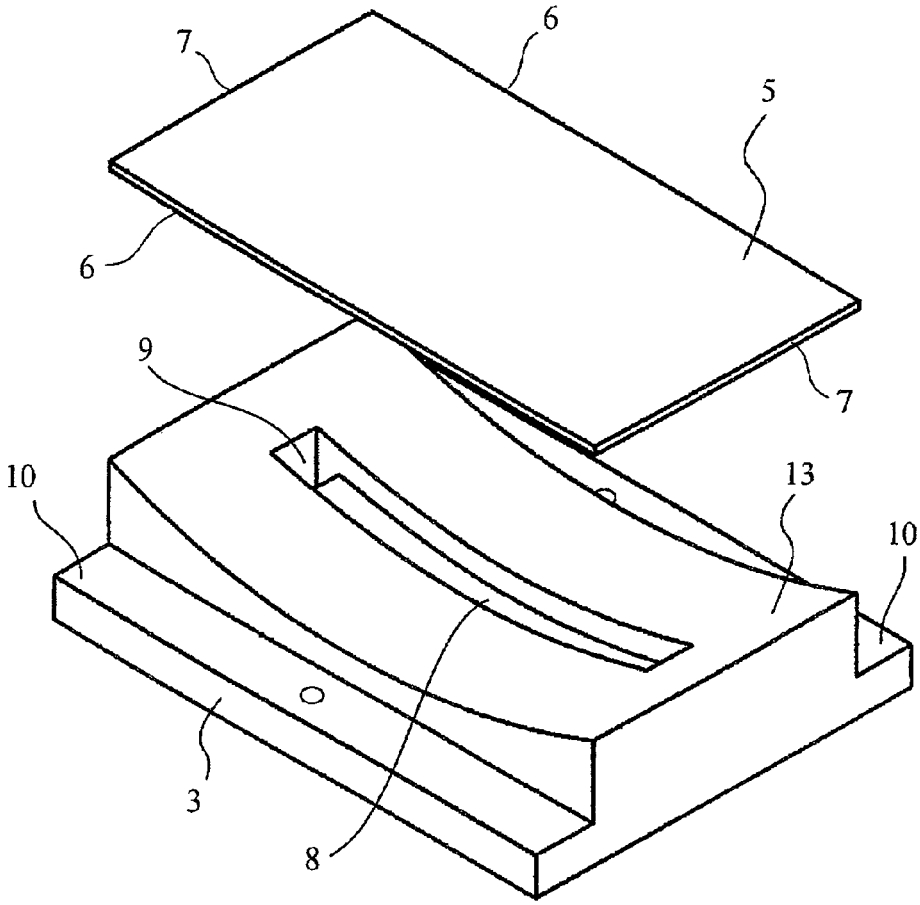
FIG. 7 is a exploded perspective view of the wave guide shown in FIG. 5.
Figure 8:
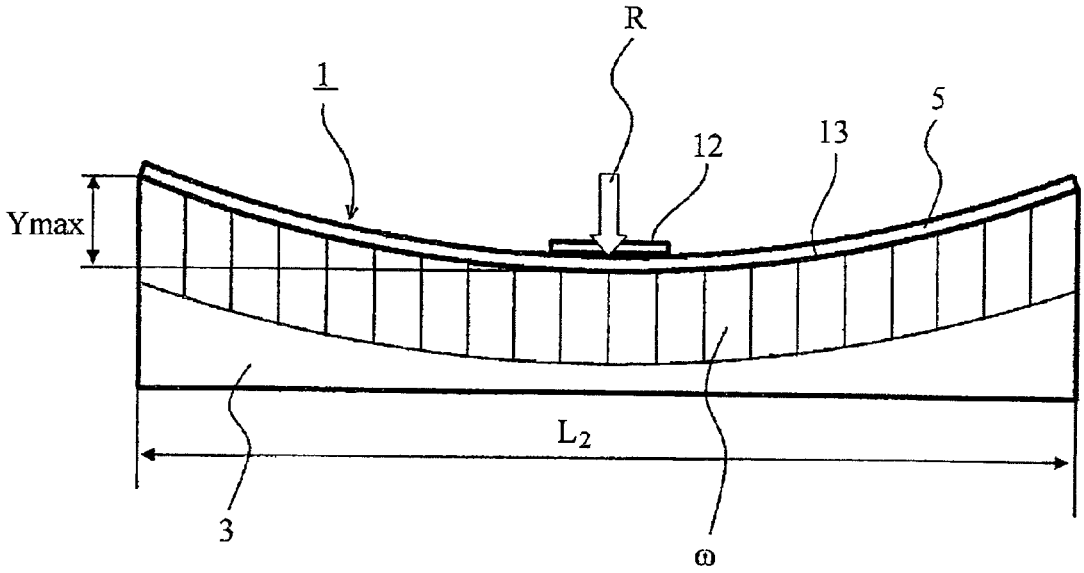
FIG. 8 is a side view for explaining distributed load, support force and flexure of the plate member of the wave guide shown in FIG. 5.

FIGS. 5-8 illustrate the waveguide of embodiment 2 of the present invention, FIG. 5 being a perspective view illustrating the waveguide of embodiment 2 of the present invention, FIG. 6 being a sectional view of the wave guide shown in FIG. 5, FIG. 7 being a exploded perspective view of the wave guide shown in FIG. 5, and FIG. 8 being a side view for explaining distributed load, support force and flexure of the plate member of the wave guide shown in FIG. 5.

In these figures, the waveguide shown in FIGS. 5-8 is different from the waveguide shown in FIGS. 1-4 in that the mounting surface 13 of the base 3 is concave (or depressed) in Y-axis direction. Also, the holders 12 are placed at the central portion of the flange 10 extending in the longitudinal direction (curvature direction) of the base 3. The holders 12 preferably hold the plate member 5 by a point contact or by a curved surface contact in a curved surface same as the flexed swept curved surface of the plate member 5 so that the holders 12 do not degrade the curvature of the plate member 5.

FIG. 8 is a side view for explaining distributed load ω, support force R and the amount of flexure Ymax of the plate member 5 pressed against the concaved mounting surface 13 of the base 3 at the central portion of the curvature direction edge portions.

Curvature curve of the mounting surface 13 is expressed by equation (3), the mounting surface 13 being a curved surface obtained by sweeping or moving this curve along a straight line. The support force R for holding the plate member 5 on the base 3 can be expressed by equation (4) per one side. The flexed plate member 5 as a leaf spring urges itself by the support force R against the mounting surface 13 of the base 3 with a uniform distributed load ω over the entire length.

$$Y=16Y\max(X^4-L_2^3 3X/2+3L_2^4/16)/(3L_2^4) \quad (3)$$

The support force for the plate member per one side is:

$$R=2Ebh^3 Y\max/(3L_2^3) \quad (4)$$

where,

Ymax: maximum amount of flexure at given point $L_2$: distance between the sweep direction edge portions of the plate member 5

E: coefficient of longitudinal elasticity of the plate member 5 b: length of sweep direction edge portion of the plate member 5 h: thickness of the plate member 5 coordinates system is as shown in FIG. 5;

point of origin: one of support positions on plate members (point of contact between the center of the curvature direction edge portion 6 and base 3)

X-axis: curvature direction (direction toward the plate member from the base 3)

Equations (3) and (4) can be easily obtained from formulae of the flexure curve and the maximum flexure for a cantilevered beam loaded with an evenly distributed load over its entire length as well as formula of second area of moment generally known in dynamics of material. In FIG. 5, z-axis indicates the sweep direction.

Therefore, when the plate-like plate member 5 is flexed along the mounting surface 13 of the base 3 and secured at the central portions of the curvature direction edge portions 6 by the supporting force R expressed by equation (4) to the base 3 having the mounting surface 13 of the swept curved surface made by sweeping the flexure curve of the cantilevered beam with a uniformly distributed load over the entire length expressed by equation (3), the plate member 5 is pressed against the mounting surface 13 with the uniformly distributed load ω over the entire length, ensuring a stable electrical conduction over the entire surface of the mounting surface 13 and preventing the leakage of the electromagnetic wave.

Thus, the curved mounting surface 13 of the base 3 is the curved surface obtained by sweeping the flexure curve (equation 3), which expresses the flexure of the plate member 5 supported only at one end and subjected to a uniform load, along a straight line, and is the rectangular curved surface having the curvature direction edge portion extending in the curvature direction and the sweep direction edge portion extending in the sweep direction. Therefore, the curved surface of the plate member 5 held on and flexed along the mounting surface 13 is also the rectangular curved surface obtained by sweeping the curve of equation (3) along a straight line and has the curvature direction edge portions 6 extending in the general direction of the curve and the sweep direction edge portions 7 extending in the direction of sweep.

In the waveguide 1 according to embodiment 2, similar superior advantageous results obtained in embodiment 1 illustrated in FIGS. 1-4 can be obtained. That is, the plate member 5 is assembled in the state in which it is always pressed against the mounting surface 13 of the base 3 by the reaction force as a leaf spring, enabling to eliminate any gap between the plate member 5 and the mounting surface 13 and to establish a good electrical conduction, whereby losses at the lines and poor isolation against other lines due to the leakage of high frequency signal can be prevented. Also, the assembly of the plate member 5 to the base 3 may be achieved by securing two holders 12 only by screws 11, leading to high productivity and low cost. Further, there is no screws or the like that project from the plate member 5 or the slot plate member, realizing a good radio wave characteristics.

Embodiment 3

Figure 9:
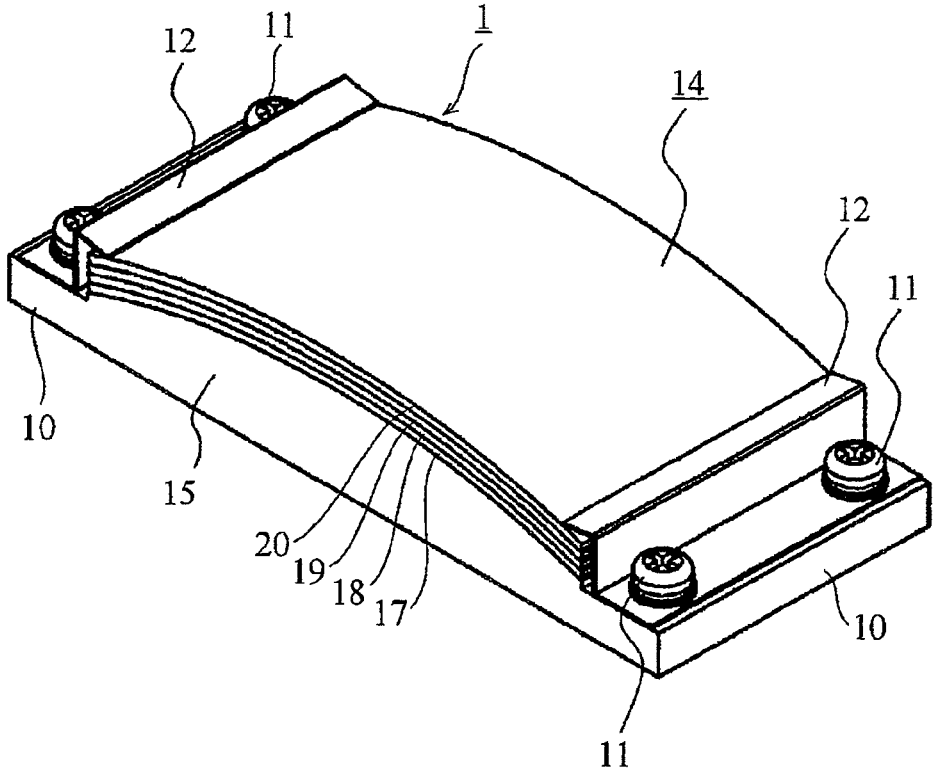
FIG. 9 is a perspective view illustrating the waveguide of embodiment 3 of the present invention.
Figure 10:
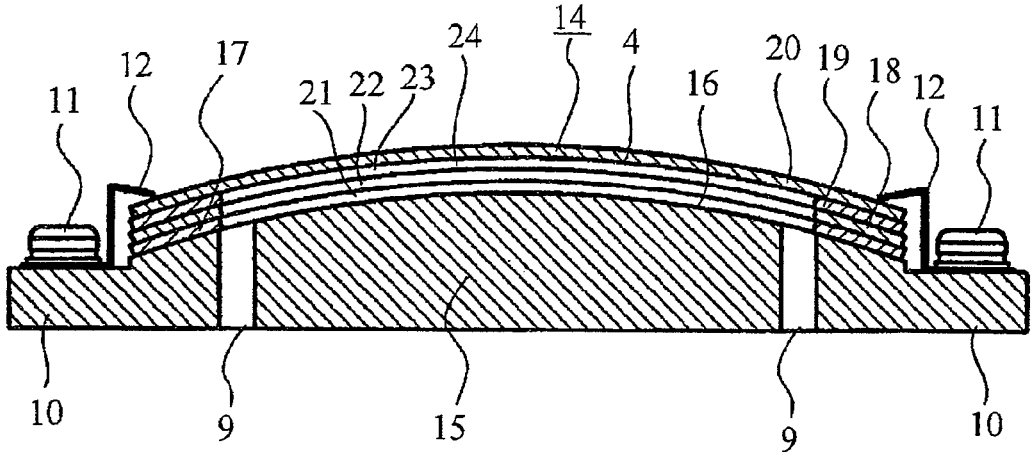
FIG. 10 is a sectional view of the wave guide shown in FIG. 9.
Figure 11:
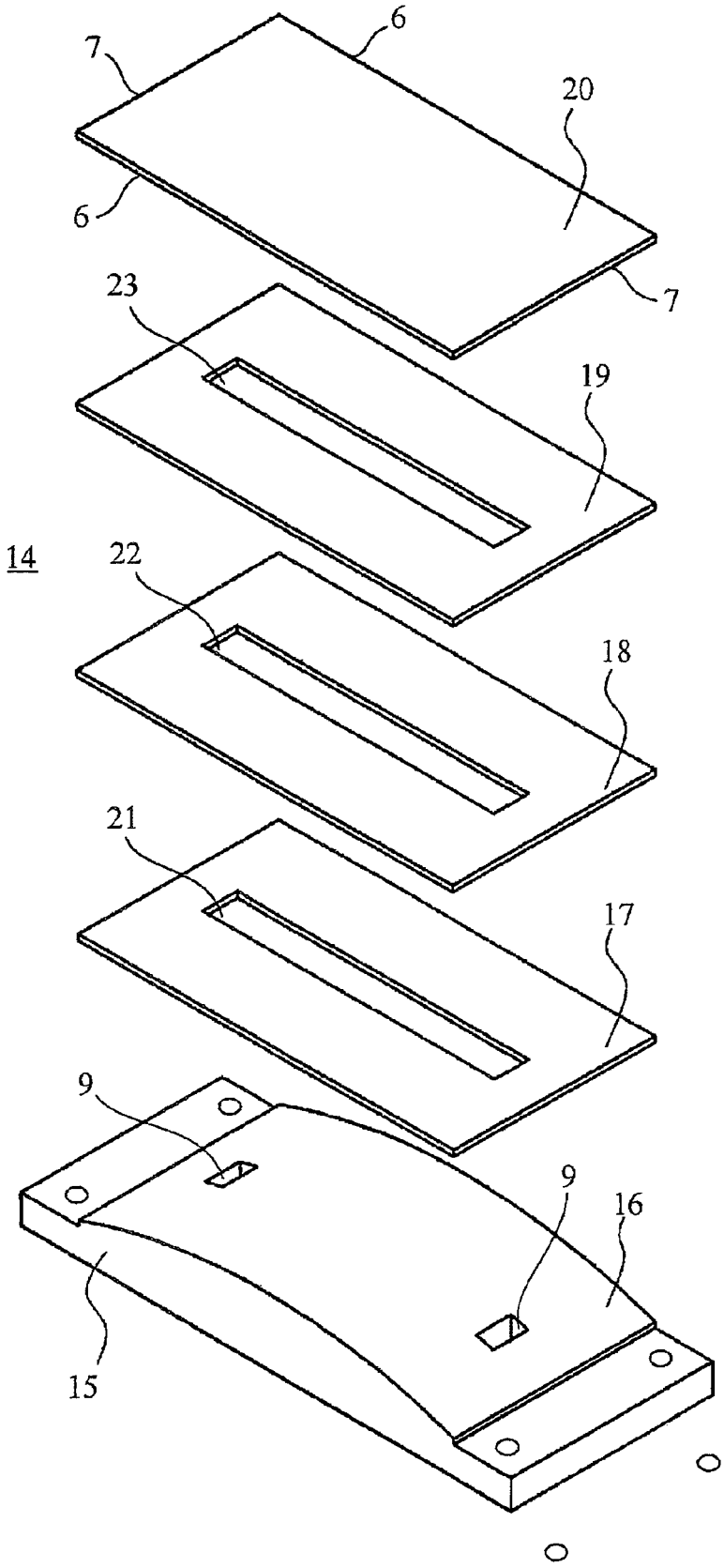
FIG. 11 is a exploded perspective view of the wave guide shown in FIG. 9.

In the waveguide 1 illustrated in FIGS. 9-11, the plate member 14 comprises a stack of first to fourth metal plates 17-20 stacked on the mounting surface 16 of the base 15, and the waveguide groove 24 is disposed in the surface of the plate member 14 facing to the mounting surface 16. The base 15 is provided with only an input/output port 9 and no waveguide groove is provided.

As shown in FIG. 11, the first to the third plates 17-19 stacked on the mounting surface 16 of the base 15 and held in an elastically intimate contacting relationship has slits 21-23 of the same configuration. The fourth plate 20 has not slit and, in the assembled state as shown in FIG. 10, the juxtaposed slits 21-23 define a waveguide groove 24 which defines, in combination with the mounting surface 16 of the base 15, the wave guide path 4 having the input/output port 9.

The plate member 14 made of the stack of the plates 17-20 is mounted to the base 15 by the holders 12 at the sweep direction edge portions 7 and is held in the position flexed along the curved mounting surface 16 of the base 15. The configuration of the mounting surface 16 of the base 5 is a curved surface formed on the bases of equation (1) in a similar manner as in embodiment 1, and the support force for the plate member 14 due to the holders 12 is a sum of four the support force R expressed by equation (2) per one side of the plates, which makes 4R. In this plate member 14, too, the flexed plates 17-20 are pressed against the base 15, and also to each other, with an even force over the entire length. In other respect, the structure is similar to those of embodiment 1.

Embodiment 4

Figure 12:
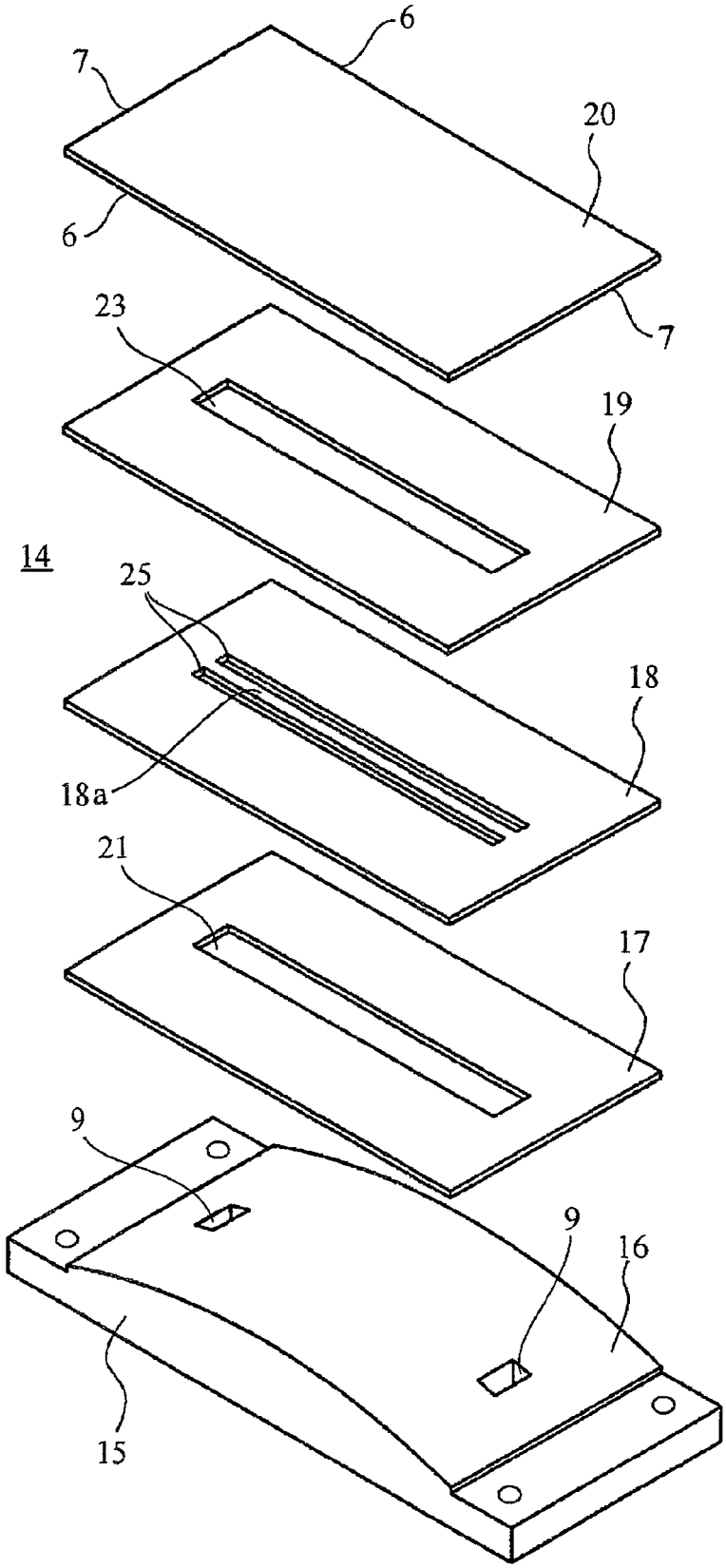
FIG. 12 is a perspective view illustrating the waveguide of embodiment 4 of the present invention.

The waveguide of another embodiment of the present invention shown in FIG. 12 has a basic structure 12 similar to that of the waveguide of embodiment shown in FIGS. 9-11, some part of the components being illustrated in exploded perspective view. In this waveguide, the second plate 18 out of the plurality of plates have two waveguide grooves 25 defining the transmission line 18*a* therebetween, and the base 15, the first, the third and the fourth plates 17, 19 and 20 define a coaxial waveguide path. In other respect, the structure is similar to those of the embodiment 3.

Embodiment 5

Figure 13:
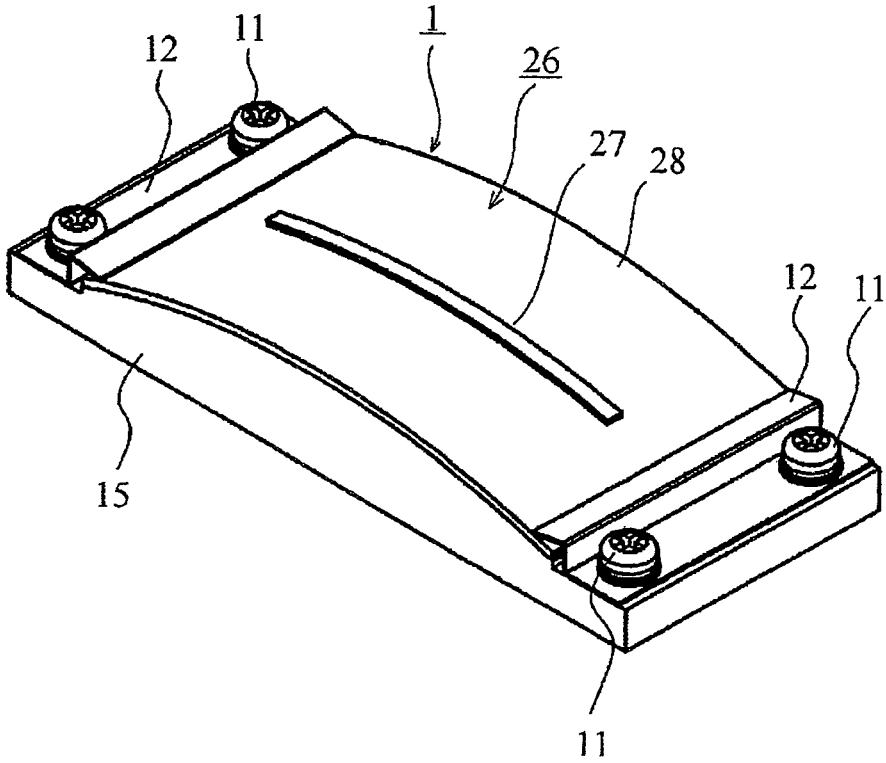
FIG. 13 is a perspective view illustrating the waveguide of embodiment 5 of the present invention.
Figure 14:
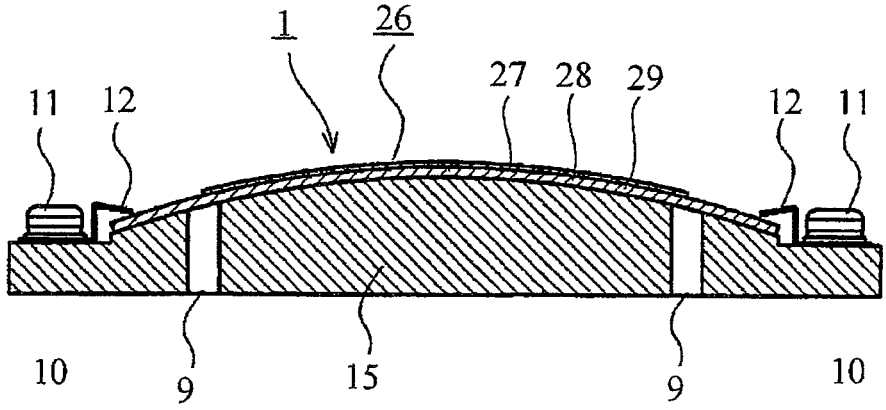
FIG. 14 is a sectional view of the wave guide shown in FIG. 13.

FIG. 13 is a perspective view illustrating the waveguide of embodiment 5 of the present invention. FIG. 14 is a sectional view of the wave guide shown in FIG. 13. In the waveguide of embodiment 5 of the present invention shown in FIG. 13, the plate member 26 is a dielectric plate 28 having a transmission line, and a waveguide path 29 including the input/output port 9 is defined between a surface of the transmission line 27 facing the base 15 and the mounting surface 2.

In the illustrated example, the plate member 26 is a printed substrate including a dielectric plate 28 having a uniform elasticity over the entire surface and a transmission line 26 which is a flat planar circuit pattern for defining a planar circuit. The plate member 26 is held at the edge with out curvature extending in the waveguide width direction, i.e., the sweep direction edge portion 7 by the holders 12 which is a leaf spring on the electrically conductive base 15. The transmission line 27 is provided on the surface of the dielectric plate 28 in correspondence with the input/output port 9 in the base 15 so that a micro-strip line is defined by the base 15 which is the ground layer and the plate member 25 which is a printed substrate.

It is to be noted that a ground layer (not shown) may be formed on the lower surface of the dielectric plate 28 of the plate member 26 which is a printed substrate and, in this case, the base 15 may either be electrically conductive or electrically non-conductive, the waveguide path 29 in either case being provided between the transmission line 27 and the ground layer (not shown) at the lower surface of the dielectric plate 28. In other respect, the construction may be similar to that of the previously explained embodiments.

Similarly to embodiment 1, the configuration of the mounting surface 2 is a curved surface obtained by sweeping the curve expressed by equation (1). The support force R for the dielectric plate 28 is the force expressed by equation (2) per one side. The flexed dielectric plate 28 as a leaf spring is urged against the base 15 by a reaction force over the entire length.

Embodiment 6

Figure 15:
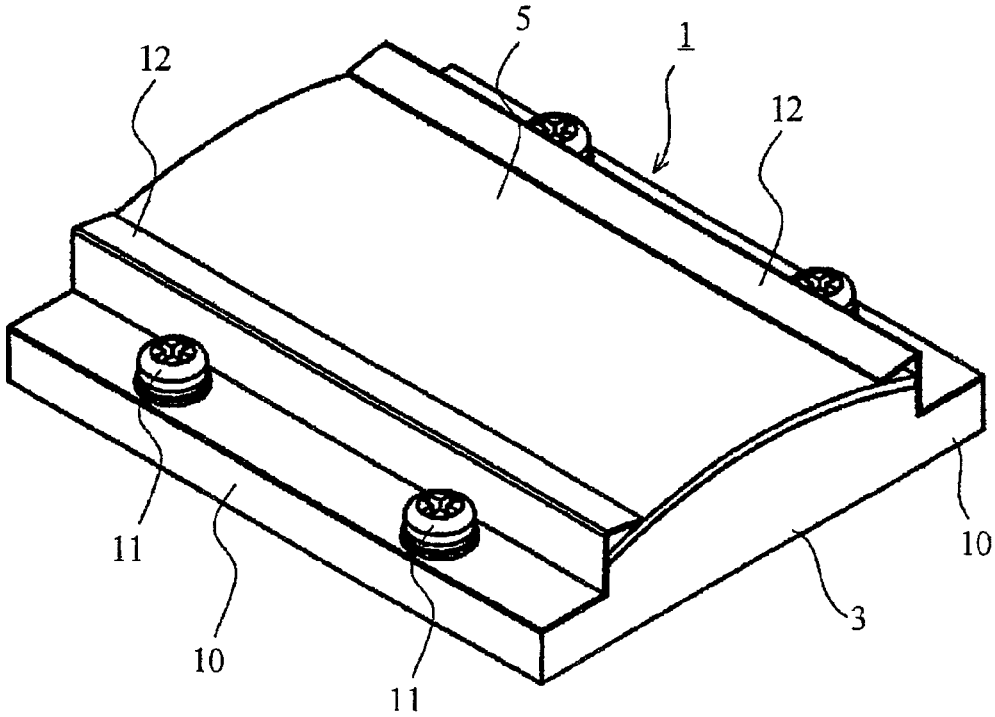
FIG. 15 is a perspective view illustrating the waveguide of embodiment 6 of the present invention.
Figure 16:
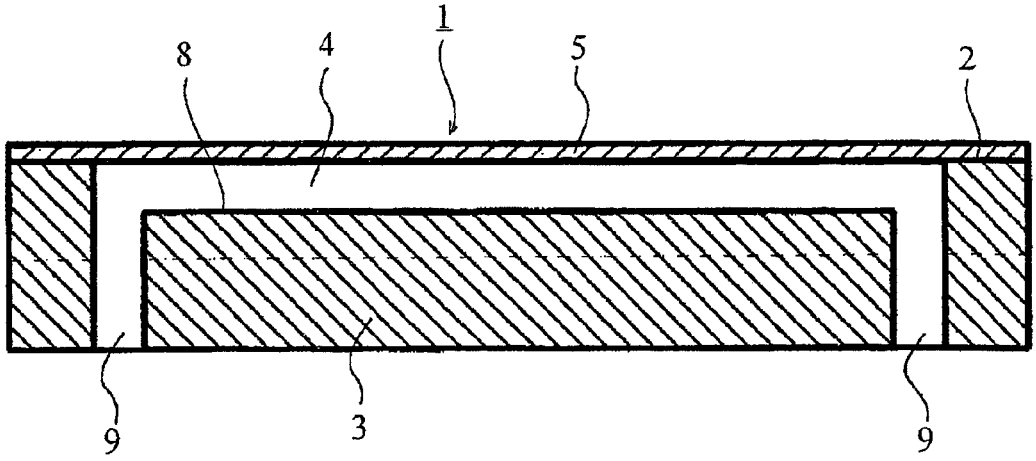
FIG. 16 is a sectional view of the wave guide shown in FIG. 15.
Figure 17:
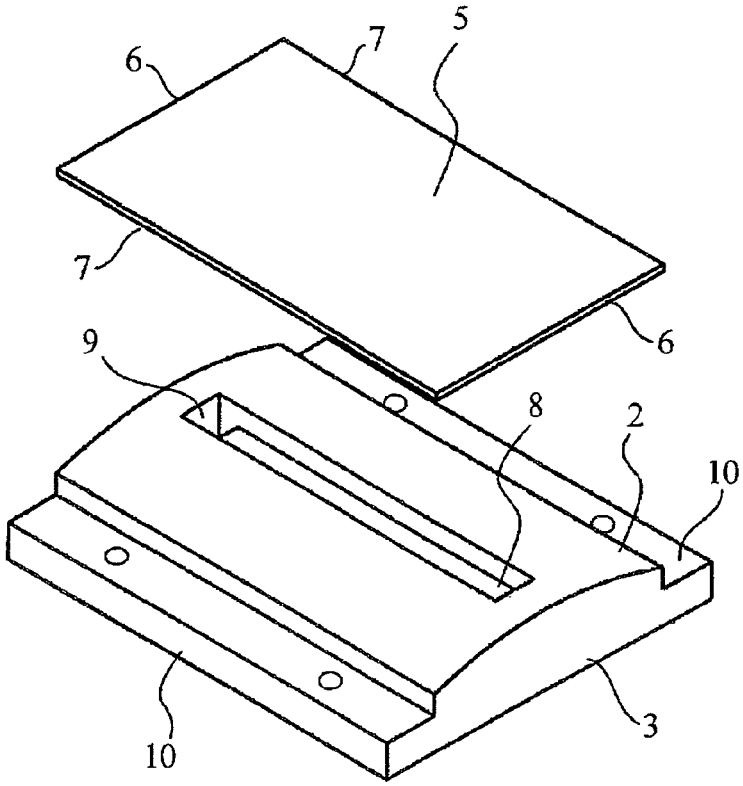
FIG. 17 is a exploded perspective view of the wave guide shown in FIG. 15.

In the waveguide illustrated in FIGS. 15-17, the waveguide groove 8 is formed to extend in the sweep direction Z, so that the waveguide path 4 is not curved but extended along a straight line and the curvature direction edge portion 6 of the plate member 5 extends in the width direction of the waveguide path 4. This is different from the curvature direction edge portion 6 of the plate member 5 of the embodiments heretofore described that extends in the longitudinal direction of the waveguide path 4. Also, the mounting surface 2 of the base 3 is curved in the width direction or along the shorter sides of the rectangular base 3 or the plate member 5 and is not curved along the longer sides. Therefore, the curvature direction edge portion 6 of the plate member 5 is located on the shorter side and the sweep direction edge portion 7 is located on the longer side. In other respects, the construction is similar to those of embodiment 1 shown in FIGS. 1-4.

Embodiment 7

Figure 18:
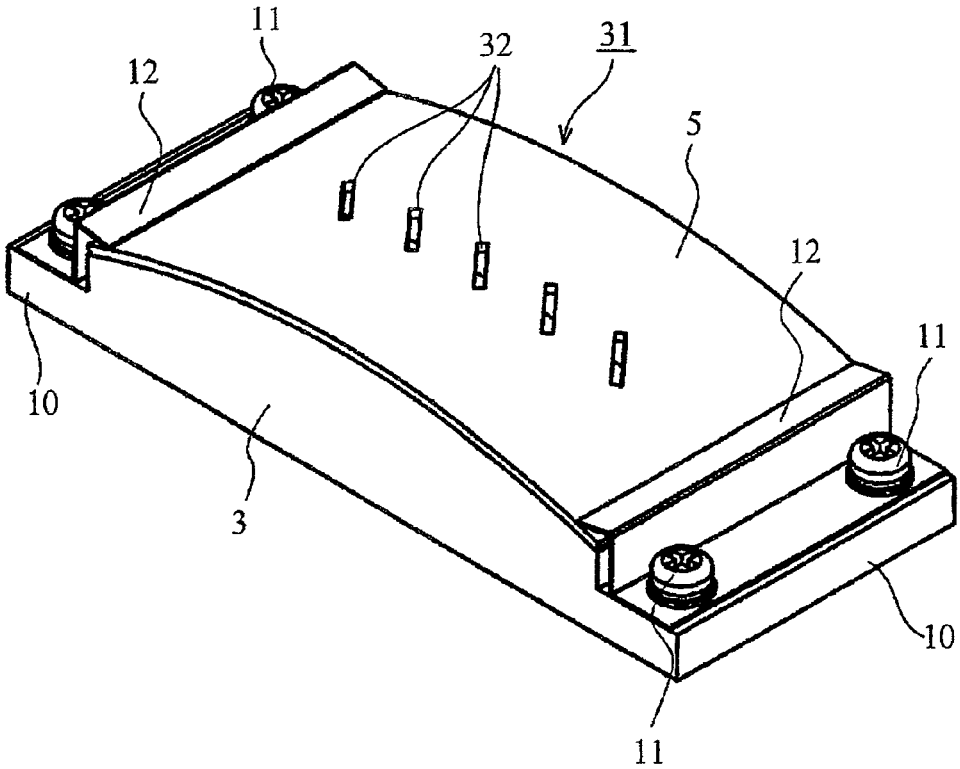
FIG. 18 is a perspective view illustrating the waveguide of embodiment 7 of the present invention.
Figure 19:
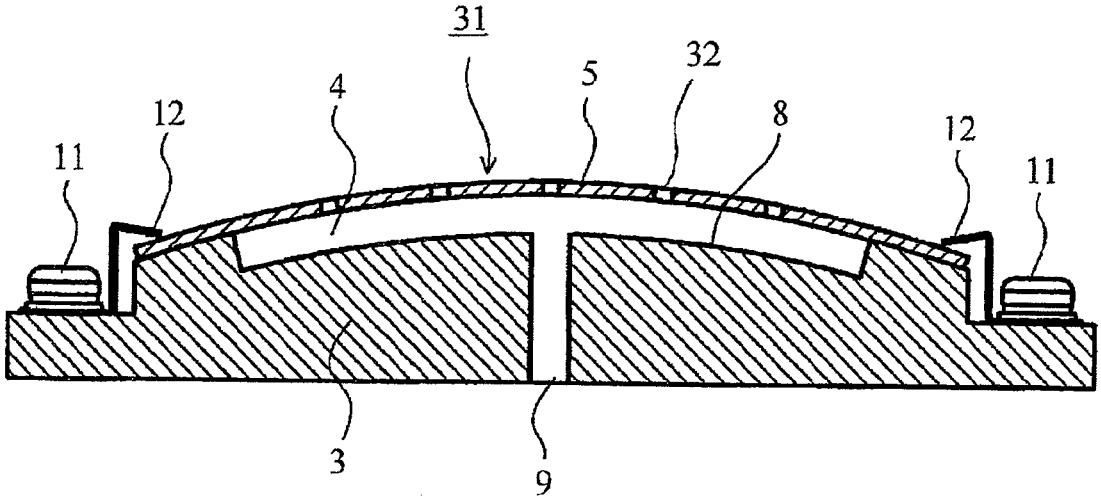
FIG. 19 is a sectional view of the wave guide shown in FIG. 18.

FIGS. 18 and 19 illustrate a waveguide antenna 31 in which the waveguide of the present invention is used. The illustrated waveguide antenna 31 uses the waveguide similar to the waveguide 1 shown in FIGS. 1-4, the difference being that antenna elements 32 which is slots are disposed in the plate member 5 which is a metal plate, and that the input/output port 9 is connected to the central portion of the wave guide groove 8, and in other structure being similar.

Embodiment 8

Figure 20:
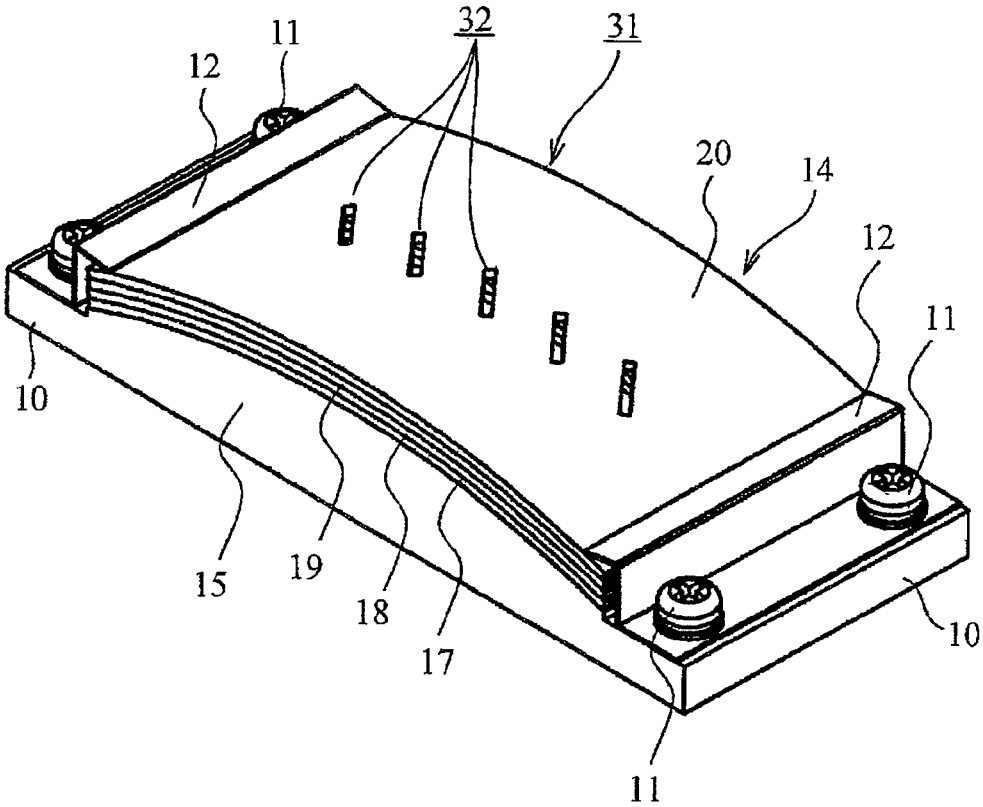
FIG. 20 is a perspective view illustrating the waveguide of embodiment 8 of the present invention.
Figure 21:
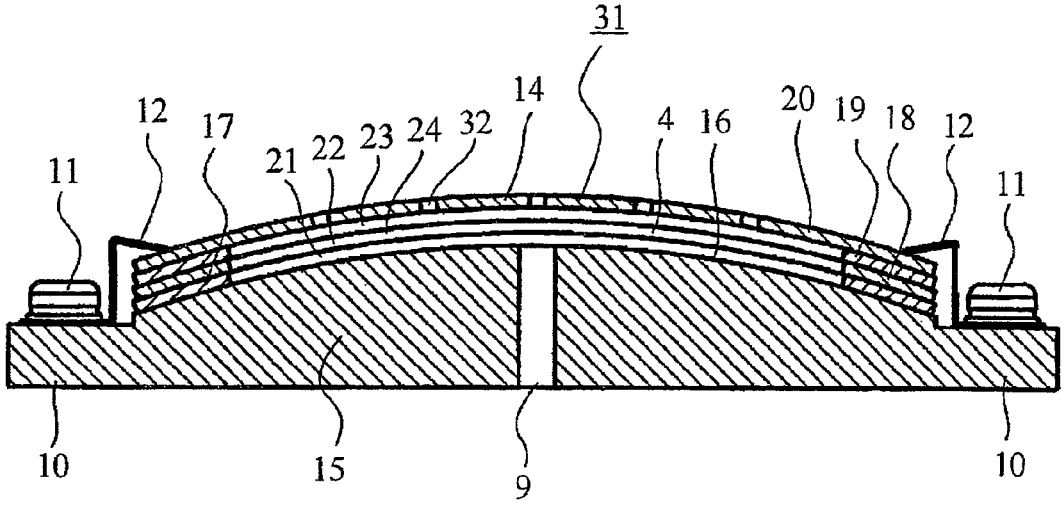
FIG. 21 is a sectional view of the wave guide shown in FIG. 20.

FIGS. 20 and 21 illustrate another waveguide antenna 31 using the waveguide of the present invention. The illustrated waveguide antenna 31 comprises a waveguide similar to the waveguide shown in FIGS. 9-11, the difference being that the antenna elements 32 are disposed in the plate member 5 which is metal plates and that the input/output port 9 is connected to the central portion of the waveguide groove 24 and other structure being similar.

Embodiment 9

Figure 22:
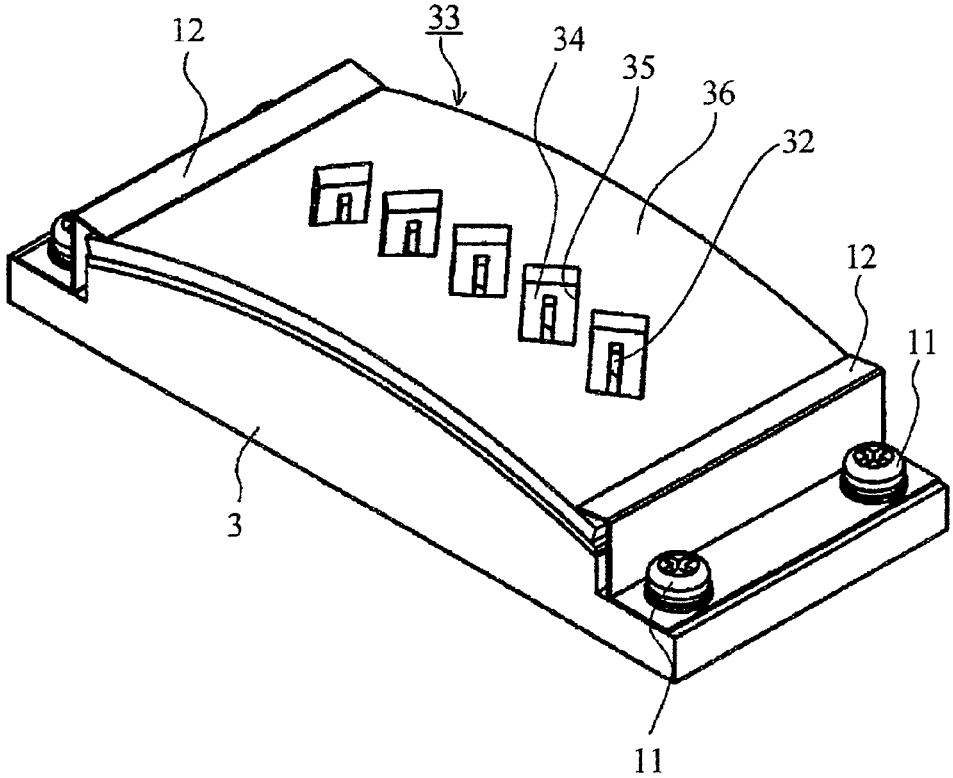
FIG. 22 is a perspective view illustrating the waveguide of embodiment 9 of the present invention.
Figure 23:
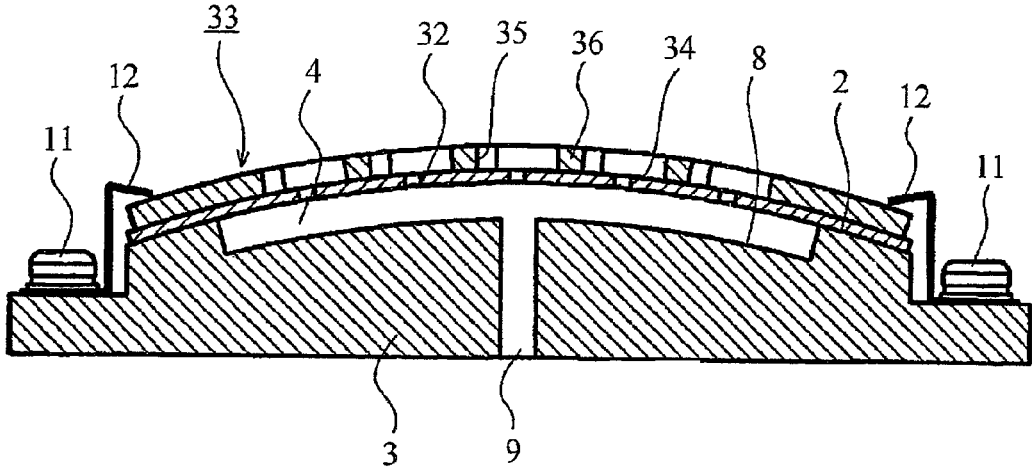
FIG. 23 is a sectional view of the wave guide shown in FIG. 22.

FIGS. 22 and 23 illustrate still another waveguide antenna 31. The basic structure of this waveguide antenna 31 is similar to that of the waveguide antenna 31 shown in FIGS. 18-19, the difference being that the plate member 33 held on the mounting surface 2 of the base 15 comprises a metal plate 34 similar to the plate member 5 shown in FIGS. 18-19 which is a metal plate in which the slots or the antenna element 32 are provided and a radio wave shield member 36 made of a metal disposed at the side of outer space (on the outer surface) of the metal plate 34 and including openings 35 surrounding each antenna element 32 of the metal plate 34. In other respects, the structure is similar to that shown in FIGS. 18-19.

The radio wave shield member 36 is thicker and higher in rigidity as compared to the metal plate 34 which is a slot plate, so that the plate member 33 including the metal plate 34 can be pressed and held on the mounting surface of the base 3 by a massive force. Generally in the waveguide antenna, a member having antennal elements is disposed at the outermost position. The member with antenna elements is usually a printed substrate or a thin metal plate with slots, providing only a low rigidity against bending. Therefore, the reaction force as a leaf spring is small and the urging force urging the plate member against the mating member is small. Also, since it is on the outermost side and there is no other member urging the plate, it is possible that the plate flexes the generates a gap. In this waveguide antenna 31, by providing the plate member 33 with the radio wave shield member 36 having a large thickness and a high rigidity on the outer space side of the metal plate 34 which is the slot plate, the metal plate 34 can be pressed against the mounting surface 2 of the base 3 with a massive force due to the large reaction force of the radio wave shield member 36 as a leaf spring, whereby a reliable electric conduction can be established. The radio wave shield member is generally provided for the purpose of reducing the grating lobe as disclosed Japanese Patent Laid-Open no. 2000-341030.

Embodiment 10

Generally, the waveguide slot antenna is desirable to radiate radio wave in the same phase from the respective slots, but in the waveguide antenna 31 of embodiment 7, for example, the plate member 5 which is the metal plate having the antenna elements 32 is curved in a convex shape, so that the position in the outer space direction of each of the antenna elements 32 is different from each other. Therefore, if radio waves in the same phase is radiated from the respective slots of the plate member 5 which is the slot plate, the composite radio wave is not a plane wave. When it is necessary to obtain a plane wave, the length of the wave guides for supplying power to the irradiation wave guide is adjusted to regulate the phase of the radio wave radiated from the respective slots, thus obtaining an antenna having desirable characteristics.

Figure 24:
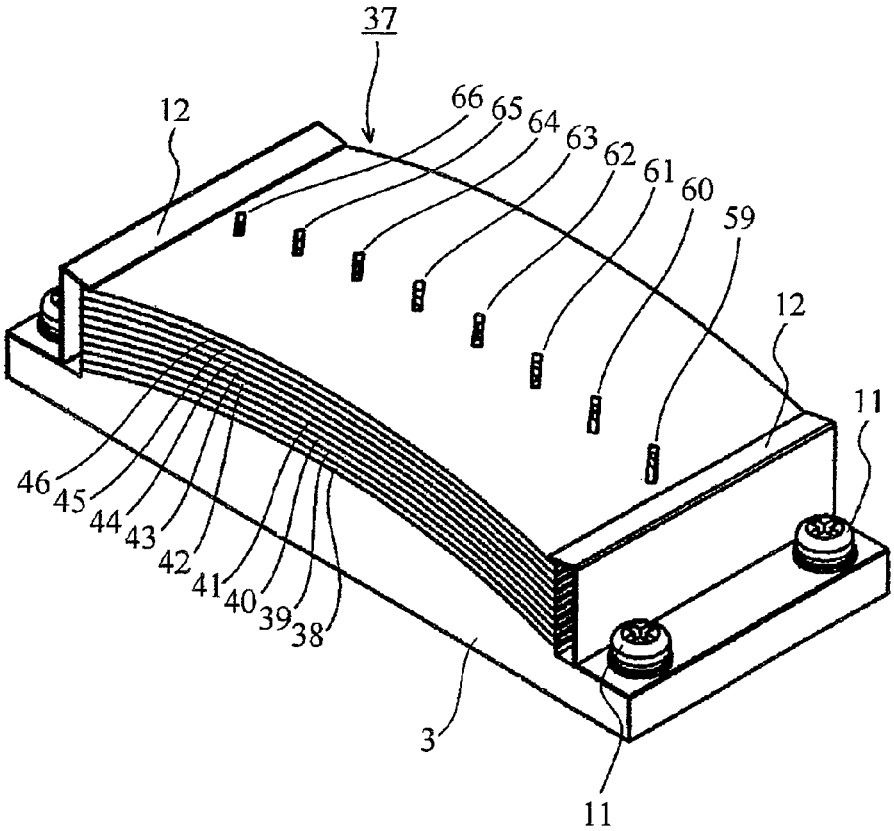
FIG. 24 is a perspective view illustrating the waveguide of embodiment 10 of the present invention.
Figure 25:
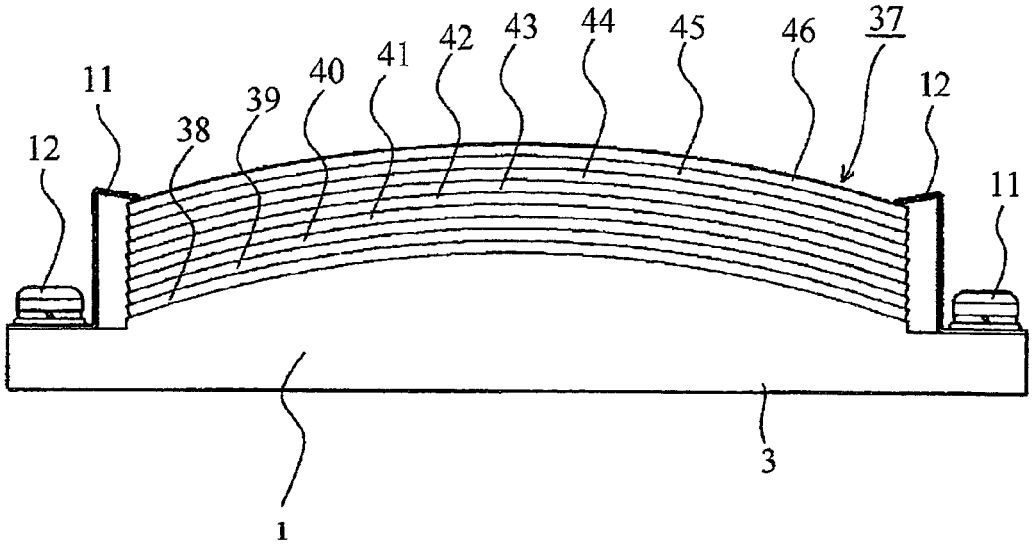
FIG. 25 is a side view of the wave guide shown in FIG. 24.
Figure 26:
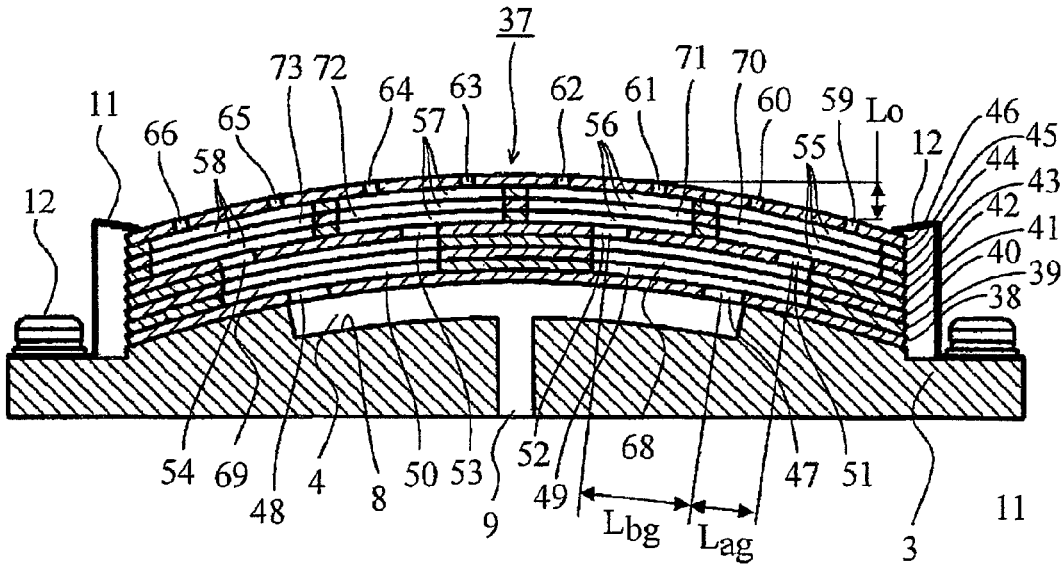
FIG. 26 is a sectional view of the wave guide shown in FIG. 24.

In the waveguide antenna according to embodiment 10 of the present invention shown in FIGS. 24-26, the plate member 37 held on the mounting surface 2 of the base 3 is a stack of a first to ninth metal plates 38-46, in which waveguide paths having different lengths to the antenna elements 32 in the outer most ninth metal plate 46 are formed.

In FIG. 26, the first metal plate 38 directly held on the mounting surface 2 to cover the waveguide groove 8 formed in the base 3 is provided with two openings 47 and 48. Also, the second to the fourth metal plates 39-41 are provided with a first opening 49 communicating with the first opening 47 of the first metal plate 38 and a second opening 50 communicating with the second opening 48 of the first metal plate 38. The fifth metal plates 42 is provided with a first and a second openings 51 and 52 communicating with the first opening 49 of the second to the fourth metal plates 39-41 and a third and fourth openings 53 and 54 communicating with the second opening 50 of the second to fourth metal plates 39-41.

The sixth to eighth metal plates 43-45 are provided with a first to fourth openings 55-58 communicating with a first to fourth openings 51-54 of the fifth metal plate 42. The ninth metal plate which is the outer most slot plate having the antennal elements 32 is provided with a first and a second slots 59 and 60 communicated with the first opening 55 formed in the sixth to eighth metal plates 43-45, a third and fourth slots 61 and 62 communicated with the second opening 56, a fifth and sixth slots 63 and 64 communicated with the third openings 57, and a seventh and eighth slots 65 and 66 communicated with the fourth openings 58.

With the above-described structure, the first to fifth metal plates 38-42 constitute the first and second power supplying waveguide paths 68 and 69 in communication with the wave guide groove 8 of the base 3, the sixth to eighth metal plates 43-45 constitute the first to fourth radiation waveguide paths 70-73, and the ninth metal plate 46 constitutes the slot plate having the antenna elements 32.

The first radiation waveguide path 70 is an end side radiation waveguide and the second radiation waveguide path 71 is a central radiation waveguide. The positional displacement of the slot between the first radiation waveguide path 70 and the second radio waveguide path 71 in the radio wave radiating direction is assumed as $L_0$ as shown in the figure. Also, assuming that the waveguide path length for supplying the first radiation waveguide path 70 of the first supply waveguide path 68 is $La_g$, and that the waveguide path length supplying to the first radiation waveguide path 71 is $Lb_g$, the phase of the electromagnetic wave supplied to the first radiation waveguide path 70 and the second radiation waveguide path 71 can be shifted by an amount corresponding the difference between $La_g$ and $Lb_g$. Therefore, by making the difference between $La_g$ and $Lb_g$ equal to the waveguide paths distance corresponding to $L_0$, then the phase shift of the radio wave radiated from the first radiation waveguide path 70 and the second radiation waveguide path 71 can be made small, whereby an antenna of good characteristics can be obtained. It is to be noted that in this antenna, the waveguide paths to be fed is made longer or shorter by an amount corresponding to a camber or the positional displacement of the slots or the antenna elements at each radio wave emission positions. It is also to be noted that while $La_g<Lb_g$ in this example, when the mounting surface 13 of the base 3 is a concave surface as in embodiment 2 shown in FIGS. 5-8, $La_g>Lb_g$ is established.

Each of the features of the embodiments heretofore described can be applied with suitable deformation, modification or eclecticism either independently or in combination into a waveguide or a waveguide antenna. For example, the feature of the concave plate member of the waveguide of embodiment 2 shown in FIGS. 5-8 may be combined with the feature that the plate member made of the stack of embodiment 3 shown in FIGS. 9-11.

By joining the metal plate 20 in which the antenna elements 32 of the waveguide antenna 31 shown in FIGS. 20 and 21 to the metal plate 19 brought into contact with the lower surface of the metal plate 20 into an integral single plate member, that is, by making the plate members 14, 31, 33 and 37, in which the antennal elements 32, 59-66 are provided, a plate member in which a plurality of metal plates are jointed together, advantageous results that the rigidity as the plate member can be increased and the electrical conduction can be ensured can be obtained.

The waveguide and the waveguide antenna are particularly suitable for use as a vehicular radar mounted on a vehicle such as automobile for monitoring the states surrounding the vehicle, which can provide a vehicular radar that is stable in operation and highly reliable by replacing the antenna of the known radar system with the waveguide antenna of the present invention.

What is claimed is:

1. A waveguide comprising:

a base having a mounting surface; and a plate member held on said mounting surface of said base for defining a waveguide path in cooperation with said base;

wherein said mounting surface of said base is a curved surface defined by a sweep along a straight line of a flexure curve of said plate member when it is loaded;

wherein said plate member is attached to said base in such a manner that said plate member is pressed against and curved along said mounting surface, and said plate member has a curvature direction edge portion extending in a curvature direction which is a direction of general extension of the flexure curve and a sweep direction edge portion extending in a direction of sweep of said curve, and wherein said curved surface of said base extends in the curvature direction to said sweep direction edge portion of said plate member extending in the direction of sweep of said curve.

2. The waveguide as claimed in claim 1, wherein said plate member is pressed against and intimately contacted with said mounting surface over an entire area of the mounting surface by a uniform load due to a reaction force of said plate member acting as a leaf spring.

3. The waveguide as claimed in claim 1, wherein said mounting surface is a convex surface and said plate member is held at the sweep direction edge portion extending in the direction of sweep.

4. The waveguide as claimed in claim 3, wherein said curved surface of said base is defined by $$Y=16Y\max X(X^3-2L_1X^2L_1^3)/(5L_1^4)$$

where,

Ymax: any maximum flexure $L_1$: a distance between plate member holding positions as for a coordinate system, point of origin: one of said plate member holding positions X:X axis curvature direction Y:Y axis direction of flexure of the plate member toward the base.

5. The waveguide as claimed in claim 3, wherein said plate member is held per one side by a holding force defined by $$R=192E\,b\,h^3\,Y\max/(60L_1^3)$$

where

E: a coefficient of longitudinal elasticity of the plate member b: a length of said sweep direction edge portion of the plate member h: a thickness of the plate member Ymax: any maximum flexure $L_1$: a distance between plate member holding positions.

6. The waveguide as claimed in claim 1, wherein said mounting surface is a concave surface and said plate member is held at said curvature direction edge portion.

7. The waveguide as claimed in claim 6, wherein said plate member is held at a central portion of said curvature direction edge portion.

8. The waveguide as claimed in claim 6, wherein said curved surface of said base is defined by $$Y=16Y\max(X^4-L_2X^3X/2+3L_2^4/16)/(3L_2^4)$$

where,

Ymax: any maximum flexure $L_2$: a distance between two opposing edges in the sweep direction of the plate member when it is held in position as for a coordinate system, point of origin: one of holding positions on the plate member X:X axis curvature direction Y:Y axis direction of flexure of the plate member toward the base.

9. The waveguide as claimed in claim 6, wherein said plate member is held per one side by a holding force defined by $$R=2E\,b\,h^3\,Y\max/(3L_2^3)$$

where

E: a coefficient of longitudinal elasticity of the plate member b: a length of the sweep direction edge portion of the plate member h: a thickness of the plate member Ymax: maximum flexure $L_2$: a distance between sweep direction edges of the plate member.

10. The waveguide as claimed in claim 1, wherein said plate member is held on said base by a leaf spring.

11. The waveguide as claimed in claim 1, wherein said base is provided at said mounting surface with a waveguide groove.

12. The waveguide as claimed in claim 1, wherein said plate member is provided at a surface facing said mounting surface of said base with a waveguide groove.

13. The waveguide as claimed in claim 12, wherein said plate member comprises a plurality of plates stacked on said mounting surface of said base, and said waveguide groove is provided in said plate member.

14. The waveguide as claimed in claim 13, wherein at least one of said plurality of plates stacked on said mounting surface of said base is provided with said waveguide groove and a second waveguide groove defining a coaxial waveguide.

15. The waveguide as claimed in claim 1, wherein said plate member comprises a dielectric plate having a transmission line, and said wave guide is defined between said transmission line and said base.

16. The waveguide as claimed in claim 15, wherein said transmission line comprises a plane circuit pattern.

17. The waveguide as claimed in claim 1, wherein said curvature direction edge portion of said plate member extends in a longitudinal direction of said waveguide.

18. The waveguide as claimed in claim 1, wherein said curvature direction edge portion of said plate member extends in a lateral direction of said waveguide.

19. An antenna comprising an antenna element disposed on said plate member of said waveguide as claimed in claim 1.

20. The antenna as claimed in claim 19, wherein said plate member on which said antenna element is disposed comprises a plurality of metal plates joined together.

21. The antenna as claimed in claim 19, wherein a radio wave shield member is provided on a exterior space side around the antenna element.

22. The antenna as claimed in claim 19, wherein said waveguide to be fed is made longer or shorter by an amount corresponding to a camber of the antenna element at each radio wave emission position.

23. A vehicular radar apparatus having an antenna as claimed in claim 19.

* * * * *